8/24/76 XR 3,976,148

United States Patent [19]

Maus et al.

[11] 3,976,148

[45] Aug. 24, 1976

[54] METHOD AND APPARATUS FOR DETERMINING ONBOARD A HEAVING VESSEL THE FLOW RATE OF DRILLING FLUID FLOWING OUT OF A WELLHOLE AND INTO A TELESCOPING MARINE RISER CONNECTING BETWEEN THE WELLHOUSE AND THE VESSEL

[75] Inventors: Leo Donald Maus; Charles Emory Barton, both of Houston, Tex.

[73] Assignee: The Offshore Company, Houston, Tex.

[22] Filed: Sept. 12, 1975

[21] Appl. No.: 612,916

[52] U.S. Cl. ..... 175/7; 73/155; 175/48

[51] Int. Cl.[2] ..... E21B 7/12

[58] Field of Search ..... 175/48, 38, 50; 166/25, 166/.5, .6; 73/155

[56] References Cited

UNITED STATES PATENTS

| | | | |
|---|---|---|---|
| 3,602,322 | 8/1971 | Gorsuch | 175/48 |
| 3,760,891 | 9/1973 | Gadbois | 175/48 X |
| 3,809,170 | 5/1974 | Ilfrey et al. | 175/7 |
| 3,811,322 | 5/1974 | Swenson | 175/48 X |
| 3,815,673 | 6/1974 | Bruce et al. | 175/25 X |
| 3,910,110 | 10/1975 | Jeffries et al. | 73/155 |

*Primary Examiner*—Ernest R. Purser
*Assistant Examiner*—Richard E. Favreau
*Attorney, Agent, or Firm*—Vinson, Elkins, Searls, Connally & Smith

[57] ABSTRACT

Method and apparatus for determining on board a heaving drilling vessel, the flow rate of drilling fluid flowing from a well hole and into a telescoping marine riser connecting the well hole with the vessel. A measuring apparatus is associated with a drilling fluid return conduit of the riser in such a position that the measuring apparatus and the portion of the conduit between the measuring apparatus and the riser are at all times filled with drilling fluid. The measuring apparatus generates a first signal proportioned to the flow rate of drilling fluid flowing therethrough, measures the drilling fluid level in the riser and generates a second signal proportional to the change in volume of the drilling fluid contained therein above the point at which the conduit intersects the riser. The telescoping movement of the riser is measured and a third signal is generated proportional to the change in volume of the flow path provided by the riser between the well hole and said point. The first, second and third signals are correlated with each other whereby the measured flow rate of the drilling fluid is modified to compensate for the telescoping of the marine riser and the drilling fluid stored in the marine riser above the point the conduit intersects with the marine riser, whereby the true flow rate of the drilling fluid flowing out of the wellhole and into the marine riser is determined onboard the heaving vessel.

11 Claims, 7 Drawing Figures

ΔQ
Q̄
Q_IN
42
2MΩ
60
20KΩ
100KΩ
55
20KΩ
59
50KΩ
20KΩ
60KΩ
54
100KΩ
Rf1
.15μf
48
Rf2
.068μf
50
14.362μf
470KΩ
7.1813μf
470KΩ
2KΩ
33.3KΩ
133.3KΩ
53
50KΩ
EXTENSION AND CONTRACTION OF RISER
X
47
SURGE TANK
h
49
MEASURING APPARATUS
0-3000 GPM
627.94Ω
51
0-3000 GPM
636.94Ω
51a
0-750 GPM
627.94Ω
56
0-750 GPM
627.94Ω
56a

METHOD AND APPARATUS FOR DETERMINING ONBOARD A HEAVING VESSEL THE FLOW RATE OF DRILLING FLUID FLOWING OUT OF A WELLHOLE AND INTO A TELESCOPING MARINE RISER CONNECTING BETWEEN THE WELLHOUSE AND THE VESSEL

BACKGROUND AND OBJECTS OF THE INVENTION

This invention relates to a method and apparatus for determining onboard a floating vessel being used to drill a subaqueous wellhole, the flow rate of drilling fluid flowing out of the wellhole into a telescoping marine riser connecting between the wellhole and the vessel. This invention has particular application to the early detection of the intrusion of formation fluids into the wellhole or the loss of drilling fluid from the wellhole to the formation.

In drilling a well, particularly an oil or gas well, there exists the danger of drilling into an earch formation that contains high pressure fluids. When this occurs, the high pressure fluid from the formation intrudes into the well and displaces the drilling fluid (mud) up the well. If this occurrence is not controlled rather quickly, the drilling fluid may be substantially displaced and the high pressure fluid may flow freely up the well. This is termed a blowout. On the other hand, the well may be drilled into an earth formation which is very porous. In such a situation, there may be a tendency for the drilling fluid to flow freely from the well into the surrounding earth formation. This is termed lost circulation.

Blowout prevention is most effective when the commencement of an influx of high pressure fluid into the well can be quickly detected and controlled before an appreciable amount of the drilling fluid is displaced from the well. Loss of drilling fluid is kept to a minimum when the commencement of the loss can be quickly detected and the flow of the fluid controlled before an appreciable amount has passed from the well into the earth formation. It is known in the art to detect such an influx or loss of fluid by comparing the flow rate of the drilling fluid into the well and the flow rate of the fluid returning out of the well. A substantial increase in the rate of the returning fluid flow when there was no corresponding increase in the rate of the fluid flow into the well, is indicative of a blowout. A substantial decrease in the rate of the returning fluid flow when there was no corresponding decrease in the rate of the fluid flow into the well, is indicative of lost circulation.

In drilling offshore subaqueous wells from floating vessels, such as ships, barges or semisubmersibles, the floating vessel is usually connected to the subaqueous wellhole by a marine riser. To accomodate the heaving motion of the vessel, the marine riser is usually provided with a telescoping section or slip joint. A hollow drill string extends downwardly from the vessel through the marine riser and into the wellhole. A drill bit is connected to the lower end of the drill string. The drill string also is usually provided with a telescoping joint (often called a "bumper sub"). Drilling fluid generally is pumped from the vessel through the hollow drill string downwardly to the drill bit. The drilling fluid flows out into the well through ports in or adjacent to the drill bit and circulates back up to the vessel through the annulus between the drill string and the marine riser.

The heaving motion of the vessel strokes the telescoping joint in the marine riser causing it to extend and contract, thereby increasing and decreasing the volume of the flow path of the drilling fluid. This results in pulsations in the rate at which the returning drilling fluid is received from the marine riser onboard the vessel. The instantaneous maximum and minimum flow rate of the returning drilling fluid induced by the extension and contraction of the marine riser may be several times greater or less than the steady state or real flow rate. In most systems for drilling subaqueous wells from floating vessels, means are employed in the vicinity of the vessel for measuring the flow rate of the drilling fluid returning to the vessel from the marine riser. As such measurement is made above the telescoping marine riser, the cyclic variations in the volume of the marine riser caused by the movement of the vessel make it difficult to determine whether a substantial decrease or increase in the flow rate of the drilling fluid returning to the vessel is due to a blowout, lost circulation, or the extension and contraction of the riser. The real flow rate of the drilling fluid out of the wellhole into the telescoping marine riser is masked by the linear extension and contraction of the marine riser whereby it is difficult, if not impossible, to detect quickly the true flow rate of the returning drilling fluid.

Gadbois, in his U.S. Pat. No. 3,760,891, discloses a method and apparatus for rapidly detecting blowouts and lost circulation in a well, which method and apparatus has particular application in a well being drilled at sea from a heaving vessel. The Gadbois system monitors the return rate of flow of the drilling fluid in the vicinity of the vessel and generates an electrical signal proportional thereto. The electrical signal is monitored, accumulated, compared with selected samples of the accumulated signal, and compared with selected threshold values, to determine the existence of the blowout or lost circulation. The Gadbois system is very advantageous but does not provide a signal which is continuously and substantially instantaneously proportional to the true flow rate of the drilling fluid flowing out of the wellhole and into the annulus between the drill string and the marine riser. Gorusch, in his U.S. Pat. No. 3,602,322, discloses a system for determining an imbalance between the rates of flow of the drilling fluid into and out of a well. Gorsuch, however, does not disclose a system which can effectively deal with the oscillations in the rates of flow of the drilling fluid in a well being drilled at sea from a heaving vessel. Jefferies et al., in their U.S. application Ser. No. 508,883, filed Sept. 26, 1974, now U.S. Pat. No. 3,910,110 issued Oct. 7, 1975, disclose a system for detecting the commencement of a blowout or lost circulation in a subaqueous well in which the rate of flow of the drilling fluid flowing back to the vessel is measured, an electrical signal is generated proportional thereto, the electrical signal is modified to compensate for the change in the volume of the flow path caused by the heaving motion of the vessel, and the modified electrical signal is compared with another electrical signal proportional to the rate of flow of the drilling fluid into the well. Alternatively, the rates of flow of the drilling fluid into and out of the well are measured, compared, and a signal is generated proportional to the difference therebetween, and such electrical signal is modified to compensate for the change in volume of the flow path of the drilling fluid caused by the heaving motion of the vessel.

It is an object of this invention to provide an improved method and apparatus for determining onboard a floating vessel being utilized to drill a subaqueous wellhole, the true flow rate of drilling fluid flowing out of the wellhole into a telescoping marine riser connecting between the wellhole and the vessel.

It is a further object of this invention to provide an improved method and apparatus for measuring the flow rate of the drilling fluid being pumped from a floating vessel into a drill string which extends into a subaqueous wellhole, for measuring the flow rate of the drilling fluid flowing back to the vessel from a telescoping marine riser connecting between the wellhole and the vessel, and for rapidly determining the difference between the flow rate of the drilling fluid being pumped from the vessel into the drill string and the flow rate of the drilling fluid flowing out of the wellhole into the marine riser whereby the commencement of a blowout or lost circulation in the wellhole may be rapidly detected onboard the vessel.

DESCRIPTION OF DRAWINGS

Referring to the drawings in which like numerals represent like parts.

DESCRIPTION OF A PREFERRED EMBODIMENT

Figure 1B:
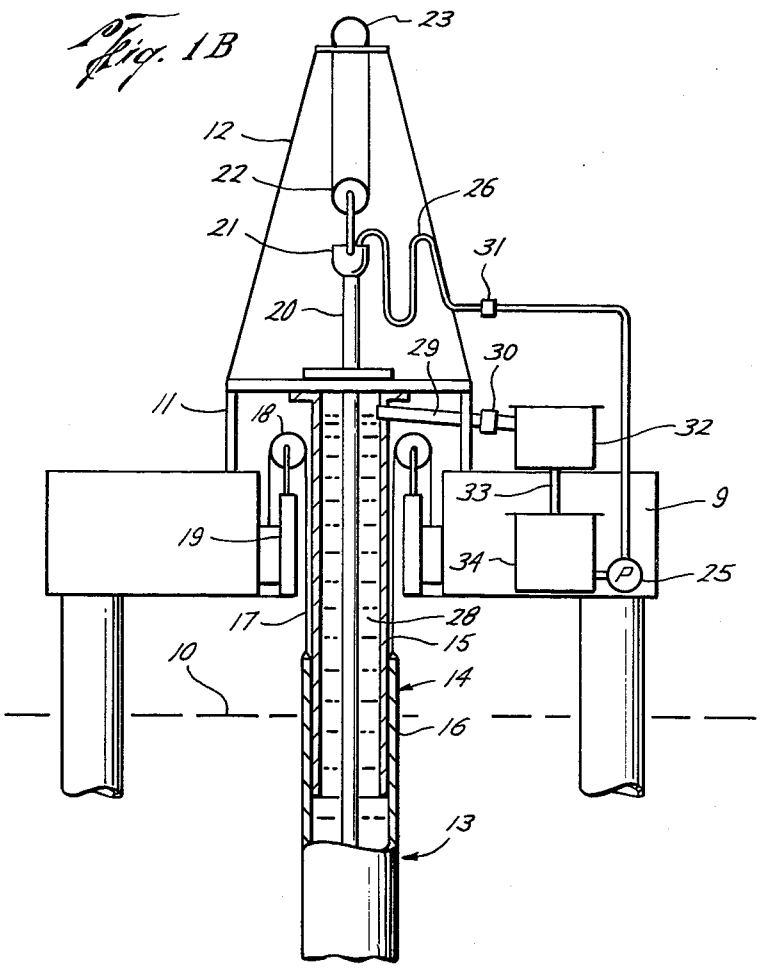
Fig. 1B PRIOR ART
FIG. 1B is an elevation view of a typical prior art system for drilling a subaqueous wellhole from a semisubmersible vessel in which the drilling fluid returning to the mud system aboard the vessel flows by force of gravity through a conduit connected between the riser and the mud processing area.
Figure 1A:
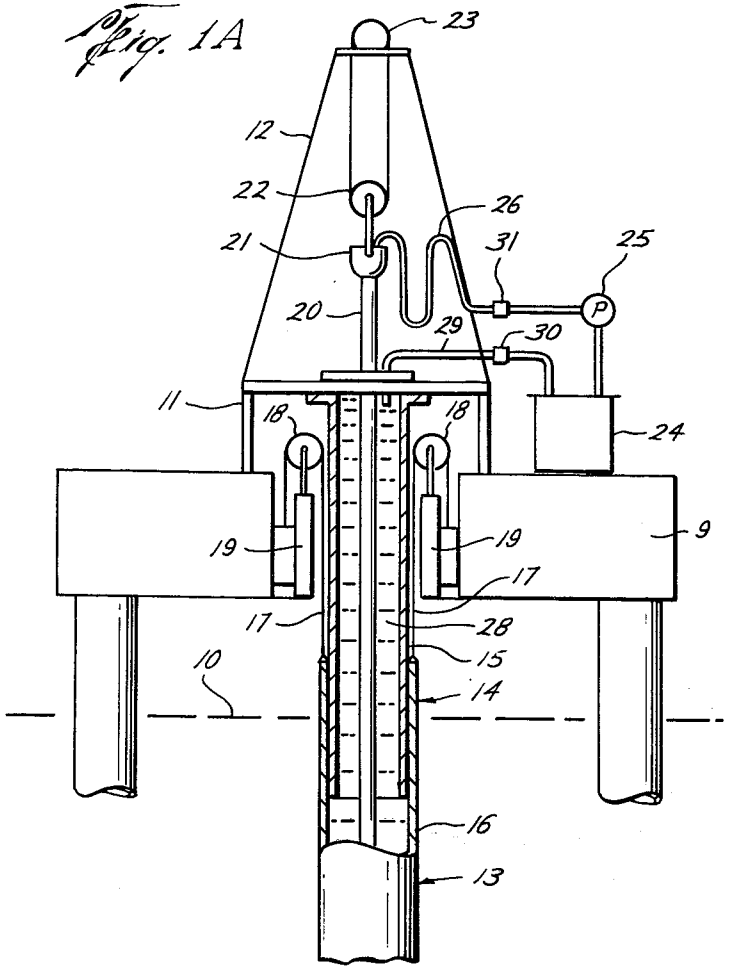
Fig. 1A PRIOR ART
FIG. 1A is an elevation view of the prior art system for drilling a subaqueous wellhole from a floating semisubmersible vessel as disclosed in the Jefferies et al application Ser. No. 508,883 in which the flow rate of the drilling fluid returning to the mud system aboard the vessel is measured and such flow rate is modified to compensate for the change in the volume of the drilling fluid flow path due to the heave of the vessel.

FIG. 1A illustrates schematically the system for detecting rapidly the commencement of a blowout or lost circulation in a subaqueous well being drilled from a floating vessel described in the Jefferies et al. application Ser. No. 508,883, filed Sept. 26, 1974, which was a continuing application of the prior pending Jefferies application Ser. No. 403,380, filed Oct. 4, 1974. A semisubmersible vessel 9 for floating on a body of water 10 is engaged in drilling a subaqueous well in the seabed. The vessel 9 mounts on its deck a substructure 11 which supports a derrick 12 which includes a draw works (not shown) and other usual apparatus for conducting drilling operations. Extending between the vessel and the wellhole in the seabed is the marine riser generally indicated at 13 which at its lower end is connected to the wellhole through the usual blowout preventer apparatus (not shown) and which at its upper end is connected to the substructure 11. The marine riser 13 includes a telescoping joint 14 near its upper end. The telescoping joint 14 includes an upper cylindrical portion 15 which is mounted from and is movable with the vessel 10 and a lower cylindrical portion 16 which remains stationary with respect to the seabed. Upward tension forces are supplied to the top of the lower cylindrical portion 16 of the marine riser 13 by cables 17 which extend around sheaves 18 carried by hydraulic piston and cylinder assemblies 19 secured to the vessel and which cables are themselves attached to the vessel. The cables 17, sheaves 18 and piston and cylinder assemblies 19 comprise so-called riser-tensioner apparatus which provide the upward forces necessary to support the marine riser. The upper portion 15 of the marine riser 13 telescopes into and out of the lower portion 16 of the marine riser 13 as the vessel moves relative to the wellhole.

A drill string generally indicated at 20 is supported from a swivel 21 within the derrick. The swivel 21 is suspended from a travelling block 22 which in turn is connected through cables to the crown block 23 at the top of the derrick. The drill string extends downwardly through the marine riser 13 into the wellhole. A bit (not shown) secured to the lower end of the drill string drills the wellhole in the earth. The drill string generally also includes telescoping joints (not shown).

In the customary manner, drilling fluid for flushing out dirt ad rock chips during drilling of the well is pumped from the mud tank 24 on the vessel 9 by pump 25 through standpipe 26 to the swivel 21. The drilling fluid is circulated down the bore of the drill string 20 and out ports in the drill bit. The drill fluid returns to the vessel through the annulus 28 between the drill string 20 and the marine riser 13. At the vessel, the drilling fluid returns to the mud tank 24 through conduit 29.

The flow rate of the drilling fluid returning to the mud tank 24 aboard the vessel is measured by a measuring apparatus 30 which generated a first electrical signal proportional thereto. The flow rate of the drilling fluid being pumped into the drill string 20 is measured by a measuring apparatus 31 which generates a second electrical signal porportional thereto.

Figure 2A:
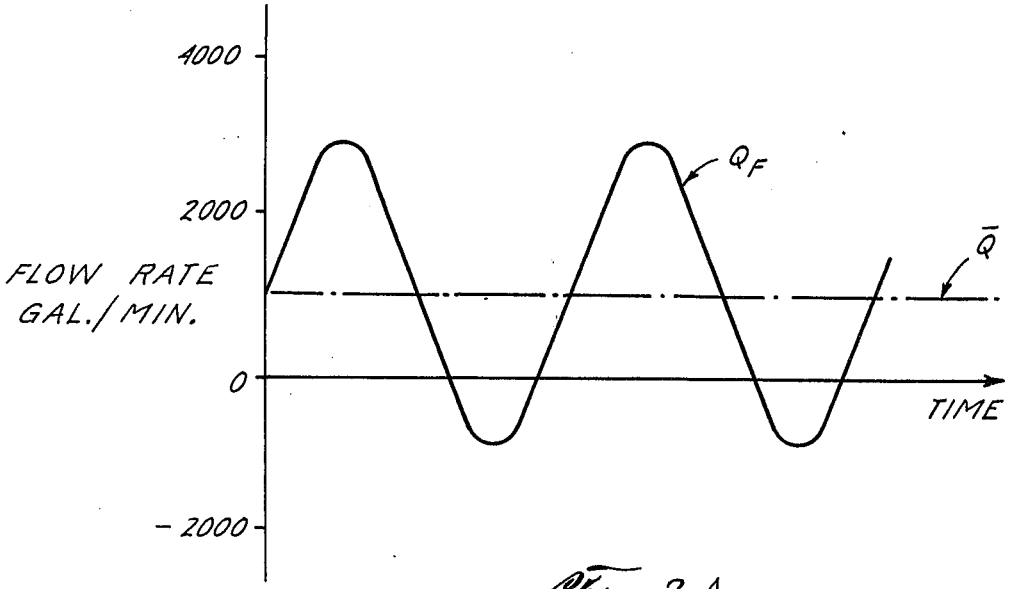
FIG. 2A is a chart depicting with respect to time the measured flow rate $Q_F$ and the true flow rate $\bar{Q}$ of the returning drilling fluid in the system illustrated in FIG. 1A.

FIG. 2A is a typical representation of the measured flow rate $Q_F$ of the returning drilling fluid as measured by the measuring apparatus 30 in the system illustrated in FIG. 1A. $\bar{Q}$ is the average or true value of the flow rate of the drilling fluid flowing out of the wellhole into the marine riser 13. As illustrated in FIG. 2A, the flow rate measured by the monitoring apparatus 30 in gallons per minute is sinusoidal responsive to the sinusoidal heave of the floating vessel. It can be observed that the measured flow rate $Q_F$ may at any given instant be several times greater than or less than the average or true value $\overline{Q}$.

The Jefferies et al. application teaches that variations in the measured flow rate $Q_F$ of the drilling fluid returning to the vessel caused by the heaving of the vessel 9 may be compensated for by modifying the first electrical signal, which is proportional to the measured flow rate of the returning drilling fluid, to compensate for the change in the volume of the flow path of the drilling fluid caused by the heaving motion of the vessel. In particular, the Jefferies et al. application teaches a method and apparatus for detecting the commencement of a blowout or lost circulation in a subaqueous wellhole connected through a riser to a floating vessel in which drilling fluid is being pumped from a mud system aboard the vessel into the wellhole and is circulated back to the mud system, wherein the rate of flow of the drilling fluid back to the mud system is detected and a signal is generated proportional thereto, and such signal is modified to compensate substantially instantaneously for the change in the volume of the flow path of the drilling fluid caused by the heaving motion of the vessel. These teachings of Jefferies et al. are very advantageous.

The particular semisubmersible vessel described and illustrated in the Jefferies et al. application includes a seal between the top of the upper portion 15 of the marine riser 15 and the substructure 11 and drill string 20 whereby the returning drilling fluid fills the entire annulus 28 between the drill string 20 and the marine riser 13 all the way up to the substructure 11. In a system constructed as illustrated in FIG. 1A, the changes in the measured flow rate $Q_F$ induced by the heave of the vessel are a predictable function of the heave.

However, most prior art systems utilized in the industry today are not constructed as shown in FIG. 1A. Rather most systems utilized in the industry today are constructed as illustrated in FIG. 1B wherein the return conduit 29 communicates with the riser 13 below the top thereof and within the substructure 11 of the semisubmersible vessel 9 (the riser-tensioner apparatus are now shown). The conduit 29 usually is quite large, such as twelve inches in diameter, to permit open-channel flow of the drilling fluid under the majority of mud flow conditions. The conduit 29 is inclined downwardly from the point that its interconnects with the marine riser 13 to a mud processing area 32 in which is located equipment such as, vibrating screens, settling tanks, centrifuges and cyclone separaters, for cleaning and conditioning its drilling fluid before the drilling fluid is returned to the wellhole. As the level of the returning fluid reaches the point that the conduit 29 intersects with the marine riser 13, the drilling fluid flows by force of gravity through the conduit 25 into the mud processing area 32. Another conduit 33 provides fluid communication from the mud processing area 32 downwardly to the active mud pits 34. Associated with the active mud pits 34 are the mud pumps 25. The drilling fluid is pumped by the mud pumps 25 through the standpipe 26 back into the drill string.

Figure 2B:
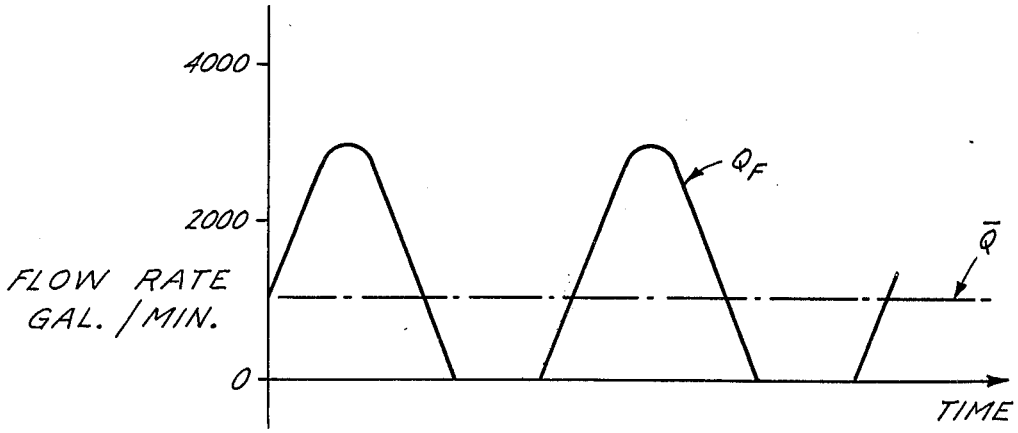
FIG. 2B is a chart depicting with respect to time the measured flow rate $Q_F$ and the true flow rate $\bar{Q}$ of the returning drilling fluid in the system illustrated in FIG. 1B.

Most such systems utilized by the industry today employ a measuring apparatus 30 in the conduit 29 to measure the flow rate of the returning drilling fluid. But in such a system there exist several alterations in the heave-induced variations of the measured flow rate $Q_F$. One alteration is that the geometry of the system, that is, the incline of the conduit 29 from the marine riser 13 to the mud processing area 32, does not permit negative flow. This changes the sinusoidal shape of the flow rate shown in FIG. 2A into a series of positive pulses such as shown in FIG. 2B. A second alteration results from the fact that these positive pulses are propagated as waves in the conduit 29 and, therefore, are not registered by the measuring apparatus 30 until sometime later than they are formed at the entrance to the conduit 29. This introduces a time delay in the signal generated by the measuring apparatus 30 in proportion to the length of the conduit 29 upstream of the measuring apparatus 30 and to the flow rate $Q_F$ through the conduit. A third alteration is the non-linear head-flow relationship found in large pipe flow. This distorts the shape of the flow rate pulses in complicated ways. The combined effect of these alterations in the heave-induced variations to the measured flow rate results in a measured flow rate signal which is no longer a simple function only of the heave of the vessel.

Figure 3:
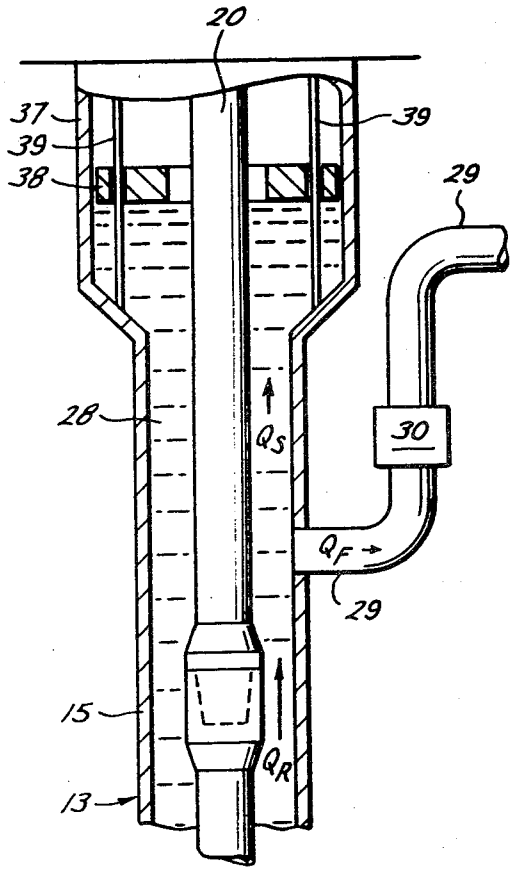
FIG. 3 is an elevational view, shown partially in schematic form and partially in cross-section, of the preferred configuration of the means for measuring the flow rate of the returning drilling fluid according to this invention.

Referring to FIG. 3, in the preferred embodiment of the system according to this invention for determining onboard the vessel the true flow rate of the drilling fluid flowing out of the wellhole into the marine riser, the conduit 29 and the measuring apparatus 30 are positioned with respect to the marine riser 13 such that the measuring apparatus 30 and the portion of the conduit 29 between the measuring apparatus 30 and the riser 13 are at all times full of drilling fluid. Preferably the upper portion 15 of the marine riser 13 contains an enlarged segment 37 which functions as a surge tank as will hereinafter be more fully explained. As illustrated in FIG. 3, preferably the conduit 29 communicates with the upper portion 15 of the marine riser 13 a selected distance below the surge tank 37 and provides a flow path for the drilling fluid upwardly to a level slightly below the mid-point of the surge tank 37 and then provides a level or downwardly inclined flow path for the drilling fluid to the mud processing area (not shown in FIG. 3). The measuring apparatus 30 is positioned in the conduit 29 a selected distance below the level of the bottom of the surge tank 37 whereby the measuring apparatus 30 at all times remains full of drilling fluid.

As drilling fluid rises in the annulus 28 between the drill string 20 and the upper portion 15 or the marine riser, it will flow into both the surge tank portion of the marine riser and the conduit 29. The level of the drilling fluid in the surge tank portion of the marine riser and in the conduit 29 will remain the same until such time as the drilling fluid level reaches the top portion of the conduit 29 whereby the drilling fluid may flow into the mud processing area 32. Since there must be a head differential between the level of the drilling fluid in the surge tank portion of the marine riser and the level of the drilling fluid in the conduit 29 to produce flow of the drilling fluid through the conduit 29 from the marine riser to the mud processing area 32, the level of the drilling fluid in the surge tank 37 will exceed that of the drilling fluid in the conduit 29 by a small amount.

As the vessel heaves, the extension and contraction of the marine riser at its telescoping joint causes variations in the volume of the flow path of the drilling fluid. This not only causes increases and decreases in the flow rate of the drilling fluid through the conduit 29 but also produces increases and decreases in the level of the drilling fluid in the annulus 28 between the drill string 20 and the marine riser 13. The vertical length of the marine riser above the telescoping joint required to accomodate the fluid displaced by the maximum contraction and extension (that is stroke) of the telescoping joint is reduced in proportion to the ratio of the flow area of the telescoping joint to the flow area of the marine riser. As such, the enlargement of the flow area of the marine riser into a surge tank produces a reservoir which can hold a much larger volume of drilling fluid than an equal length of the ordinary marine riser and diminishes the magnitude of the changes in the level of the drilling fluid in the marine riser. Preferably the flow area of the surge tank 37 is two to 20 times larger than the flow area of the marine riser. Since the surge tank 37 reduces the variations in the level of the drilling fluid, it also reduces the head differential between the level of the drilling fluid in the marine riser and the level of the drilling fluid in the conduit 29, which tends to even out the changes in the rate the drilling fluid flows through the conduit 29.

Assuming the drilling fluid to be incompressible for the range of pressures encountered in the portion of the drilling fluid system illustrated in FIG. 3, the following equation holds:

$$Q_R = Q_S + Q_F \quad (1)$$

wherein $Q_R$ is the instantaneous flow rate of the drilling fluid in the annulus 28 below the intersection of the conduit 29 and the marine riser 13, $Q_S$ is the instantaneous flow rate of the drilling fluid in the annulus 28 above the point of intersection of the conduit 29 and the marine riser 13, and $Q_F$ is the instantaneous measured flow rate of the drilling fluid in the conduit 29. Directions of positive flow are as indicated by the arrows in FIG. 3.

The flow rate $Q_R$ of the drilling fluid in the annulus 28 below the point that the conduit 29 intersects with the marine riser 13 consists of two primary parts: the true flow rate $\bar{Q}$ of the drilling fluid flowing from the wellhole into the marine riser and the component of the flow rate of the drilling fluid caused by the extension and contraction of the telescoping joint in the marine riser. If X is proportional to the linear extension and contraction of the telescoping joint in the marine riser and $A_a$ is the annular cross-section of the flow area of the annulus 28 at the telescoping joint, $Q_R$ can be expressed as the following equation:

$$Q_R = \bar{Q} - A_a\, dx/dt \quad (2)$$

If $A_S$ is the net cross-sectional area of the surge tank 37 occupied by drilling fluid and $h$ is the height of the drilling fluid in the surge tank, the flow rate $Q_S$ into or out of the surge tank can be expressed as the following equation:

$$Q_S = A_S\, dh/dt \quad (3)$$

Combining equations 1, 2 and 3 and solving for the desired quantity $\bar{Q}$ yields the following equation: $\phi$ $$\bar{Q} = Q_F + A_a\, dx/dt + A_S\, dh/dt \quad (4)$$

In the foregoing, the only change in the volume of the drilling fluid flow path which has been considered is due to the extension and contraction of the telescoping joint in the marine riser. This situation is realized in practice only if the drilling vessel is equipped with a recently introduced device called a "motion compensator". This device attaches to either the traveling block 22 or the crown block 23 in FIG. 4 (not shown) and serves to maintain the elevation of the top of the drill string 20 constant with respect to the seafloor. With this device, there is no change in the volume of drilling fluid within the drill string due to vertical motion of the vessel. On vessels not equipped with a motion compensator, it is well-known in the art to include one or more telescoping sections in the drill string ("bumper subs") to extend and contract in the length of the drill string as the vessel heave, thereby maintaining the bit in contact with the bottom of the wellbore. Under these circumstances, it may be desirable to slightly increase the parameter $A_a$ in equation 4 to include the relatively small internal flow area of the bumper sub in addition to the annulus flow area of the marine riser to account for the total change in the volume of the drilling fluid flow path.

Figure 4:
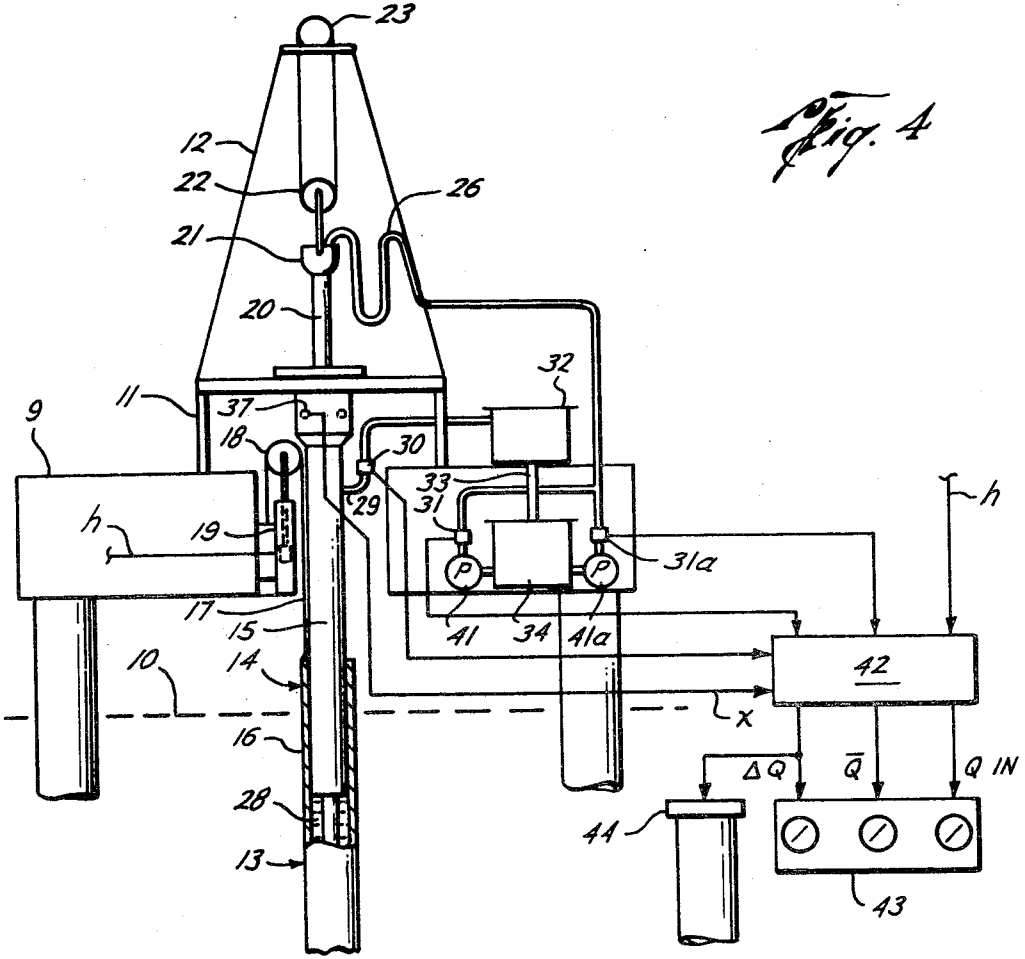
FIG. 4 is a schematic view of the preferred system according to this invention for rapidly determining onboard a floating vessel the difference between the flow rate of the drilling fluid being pumped from the vessel into the drill string and the true flow rate of the drilling fluid returning from the wellhole to the marine riser connecting between the wellhole and the vessel, whereby the commencement of a blowout or lost circulation in the wellhole may be rapidly detected onboard the vessel.
Figure 5:
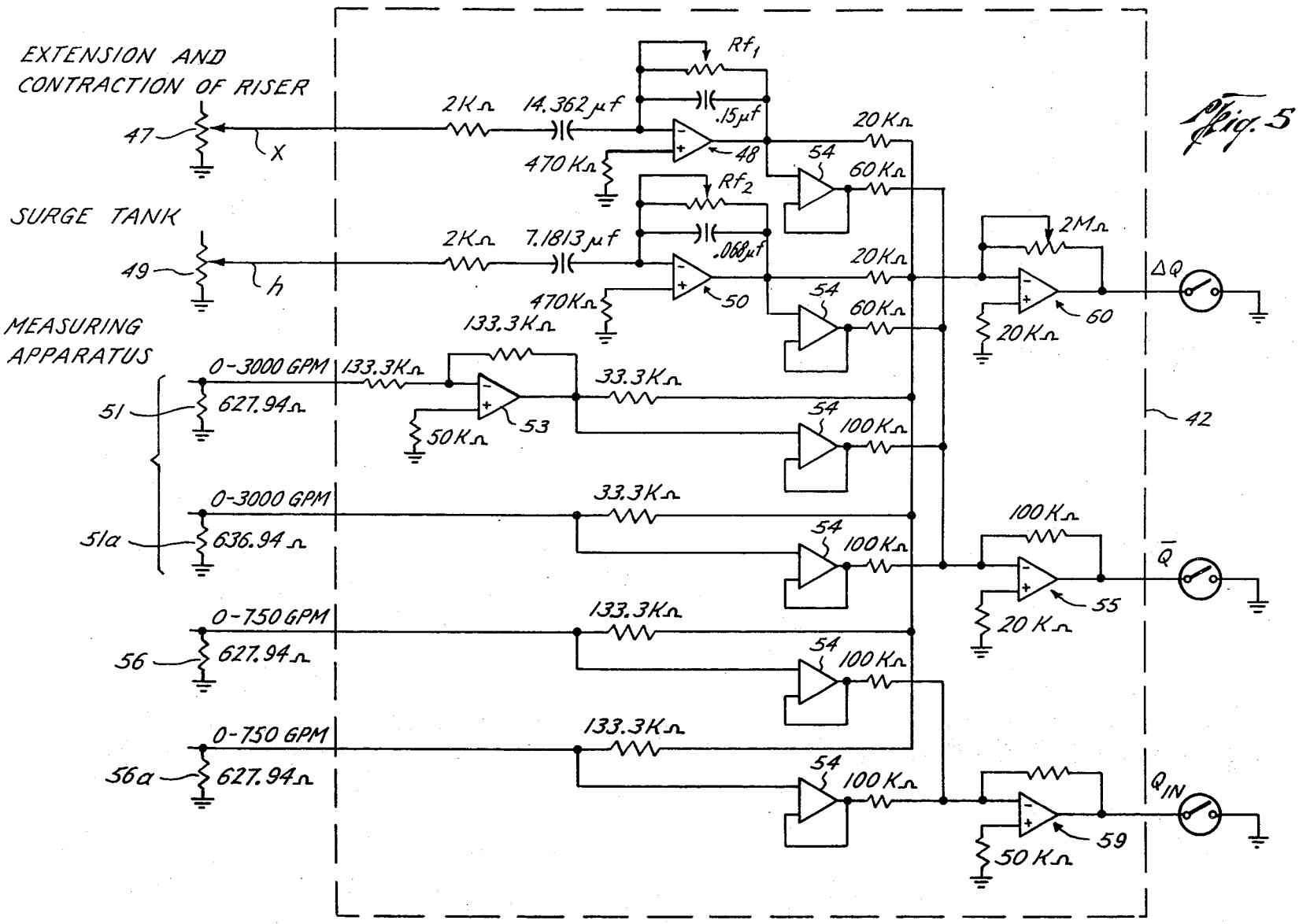
FIG. 5 is a schematic view of the preferred electrical components of the processor illustrated in FIG. 4.

Referring now to FIGS. 3, 4, and 5, the preferred apparatus according to this invention comprises the marine riser 13 which interconnects at a selected point with the conduit 29. A measuring apparatus 30, such as a Fischer and Porter Model 110D1430 Magnetic Flowmeter is secured to the conduit 29 at a preselected location. The measuring apparatus 30 preferably generated an electrical signal proportional to the flow rate of the drilling fluid through the conduit 29, the polarity of which electrical signal is also indicative of the direction of the drilling fluid is flowing through the conduit 29. At a selected elevation in the marine riser above the elevation of the measuring apparatus 30, the marine riser enlarges into a surge tank 37. The conduit 29 preferably rises to an elevation somewhat below the mid-point of the surge tank 37 and then proceeds in a horizontal or downwardly inclined fashion to the mud processing area 32. The elevations of the surge tank and the upper portion of the conduit 29 and the elevation of the measuring apparatus 30 are selected such that in perfectly calm seas the level of the drilling fluid in the surge tank 37 remains substantially at its mid-point for the range of flow rates $\bar{Q}$ for which the system is designed. The length of the surge tank 37 is selected such that the maximum variations in the level of the drilling fluid can be accomodated within the region of constant cross-sectional area. The elevation of the measuring apparatus 30 is selected to be below that of the minimum anticipated level of the fluid in he surge tank 37 so that the measuring apparatus will remain full of drilling fluid at all times.

A means is employed for determining the level of the drilling fluid in the annulus between the drill string and the marine riser and generating an electrical signal proportional thereto. Preferably this comprises means associated with the surge tank 37 for determining the elevation of the drilling fluid within the surge tank and for generating an electrical signal proportional thereto. As illustrated in FIG. 3, these means preferably include a ring float 38 secured around the drill string 20 and held in place by a plurality of vertically mounted reed switch level sensors 39, such as tank level transmitters manufactured by the Gems Sensor Division of Delaval, Inc. The reed switch level sensors 39 generate electrical signals representative of the level of the ring float 38 within the surge tank 37.

A means is employed for continuously determining the extension and contraction of the marine riser as such extension and contraction has the effect of increasing or decreasing the volume of the flow path of the drilling fluid. This can be accomplished in numerous ways well known to those skilled in the art. It can be accomplished through sophisticated electronics utilizing accelerometers and other commercially available position sensors, such as RADAR, SONAR or LASERS. However, the preferred manner of determining the extension and contraction of the marine riser is to attach cables between the vessel and the portion of the marine riser 13 which is secured to the wellhead. As shown schematically in FIG. 4, such a cable 17 preferably is then reaved around a sheave 18 and fastened to the vessel. The sheave 18 is attached to the end of a piston rod which is a part of a piston and cylinder assembly 19. Hydraulic fluid is supplied into the piston and cylinder assembly against a selected side of the piston as is well known in the art. As a semisubmersible vessel moves relative to the wellhead, the cylinder and the piston move relative to each other. The movement of the piston relative to the cylinder is transduced into a signal *h* proportional thereto such as is well known to those skilled in the art.

The drilling fluid is transmitted from the mud processing area 32 through conduit 33 to the active mud pits 34. From there, the drilling fluid is pumped by mud pumps 41 and 41*a* (shown schematically in FIG. 4) back well known in the art. As a semisubmersible vessel moves relative to the wellhead, the cylinder and the piston move relative to each other. The movement of the piston relative to the cylinder is transduced into a signal *h* proportional thereto such as is well known to those skilled in the art.

The drilling fluid is transmitted from the mud processing area 32 through conduit 33 to the active mud pits 34. From there, the drilling fluid is pumped by mut pumps 41 and 41*a* (shown schematically in FIG. 4) back into the drilling system. A measuring apparatus 31 and 31*a* is associated with each mud pump 41 and 41*a* or the conduit through which the mud is pumped.

As illustrated in FIG. 4, the signals generated by the input measuring apparatus 31 and 31*a* proportional to the flow rate of the drilling fluid pumped from mud pumps 41 and 41*a* are coupled to the input of a processor 42. The flow rate of the drilling fluid being supplied to the drilling system is the sum of such two signals and may be expressed by the following equation:

$$Q_{in} = Q_{41} + Q_{41A} \tag{5}$$

Also coupled to the processor 42 is the signal X generated by the means for detecting the extension and contraction of the telescoping joint; the signal *h* generated by the means for determining the height of the drilling fluid in the marine riser 13 above the point that the conduit 29 connects with the marine riser 13, which in the preferred embodiment of this invention is the height of the drilling fluid in the surge tank 37; and the signal $Q_F$ generated by the measuring apparatus 30 proportional to the flow rate of the drilling fluid through the conduit 29. The processor 42 receives the signals supplied to its input and determines the flow rate $Q_{in}$ of the drilling fluid supplied to the drilling system in accordance with equation 5, determines the average or true flow rate $\bar{Q}$ of the drilling fluid in the annulus 29 of the marine riser below the telescoping joint, and determines the difference in the flow rate $\Delta Q$ between the true flow rate $\bar{Q}$ of the drilling fluid in the annulus below the telescoping joint and the flow rate $Q_{in}$ of the drilling fluid being supplied to the system in accordance with the following equation:

$$\Delta Q = \bar{Q} - Q_{in} \tag{6}$$

The processor 42 preferably outputs signals proportional to $Q_{in}$, and $\bar{Q}$ and $\Delta Q$ and supplies such signals to the driller's console 43 which displays such flow rates in normal numerical form. The output signal $\Delta Q$ is also preferably supplied to the input of recorder 44 which makes a permanent record of the difference in the flow rate of the fluid flowing from the wellhole into the marine riser and the drilling fluid input to the drilling system with respect to time.

FIG. 5 illustrates the preferred components of the processor 42. The means for determining the extension and contraction of the telescoping joint in the marine riser and generating an electrical signal proportional thereto, is depicted as a potentiometer 47. The electrical signal *x* generated by such means for determining the extension and contraction of the telescoping joint in the marine riser, is supplied to the processor 42 and coupled to an amplifier circuit 48 which differentiates such signal with respect to time and generates an electrical signal which is proportional to the rate in change in volume of the return flow path of the drilling fluid caused by the extension and contraction of the telescoping joint in the marine riser. Preferably the means for generating the electrical signal *x* responsive to the extension and contraction of the telescoping joint of the riser (depicted as the potentiometer 47) varies through a zero-to-10 volt range responsive to a 40 foot extension of the telescoping joint and the signal generated by the differential amplifier circuit varies through a plus or minus 12 volt range indicative of plus or minut 6000 gallons per minute of drilling fluid flowing into or being expelled from the extending or contracting telescoping joint in the marine riser.

The means for determining the level of the drilling fluid in the annulus between the drill string and the marine riser above the point the conduit intersects with the riser and for generating an electrical signal proportional thereto, is depicted as a potentiometer 49. The electrical signal *h* generated by such means for determining the level of the drilling fluid in the annulus between the drilling string and the marine riser, is supplied to the processor 42 and coupled to an amplifier circuit 50 which differentiates such signal with respect to time and generates an electrical signal which is proportional to the rate of change in the volume of the drilling fluid being stored in the annulus as a result of the increase and decrease in the level of the drilling fluid in such annulus. Preferably the means for generating the electrical signal *h* responsive to the change in the level of the drilling fluid in the annulus is mounted in a surge tank and varies through a range of zero-to-10 volts responsive to a 4 foot change in the level of the drilling fluid in the surge tank. Preferably the electrical signal generated by the differential amplifier circuit 50 varies through a plus or minus 12 volt range indicative of plus or minut 6000 gallons per minute of drilling fluid flowing into or out of the annulus (preferably the surge tank) as a result of the change in the level of the drilling fluid in the annulus.

The measuring apparatus 30 positioned in the conduit 29 for determining the flow rate of the drilling fluid through the conduit 29 preferably generates an electrical signal proportional to the flow of the drilling fluid through the conduit 29 and indicative of the direction of flow. Due to the characteristics of the preferred measuring apparatus 30, the Fischer and Porter Model 110D1430 magnetic flowmeter, the portion of the measuring apparatus electrically depicted as resistor 51 preferably generates an electrical signal which varies from zero-to-10 volts responsive to a flow rate of zero to 3000 gallons per minute of drilling fluid flowing in the direction away from the marine riser. The portion of the measuring apparatus electrically depicted as resistor 51*a* preferably generates an electrical signal which varies from zero-to-10 volts responsive to a flow rate of zero to 3000 gallons per minute of drilling fluid flowing in the direction toward the marine riser. Due to the characteristics of the preferred measuring apparatus, the electrical signal generated by the portion of the measuring apparatus depicted as resistor 51 is coupled to an amplifier circuit 53 which functions to invert the signal. The outputs of the amplifier circuit 53 and resistor 51*a* are coupled together and the electrical current signal supplied over the coupled lines is proportional to the flow rate $Q_F$ of the drilling fluid through the measuring apparatus and indicates the direction of such flow.

Preferably each of the electrical signals output by amplifier circuit 53 and resistor 51*a* (the sum of which is proportional to the flow rate $Q_F$ of the drilling fluid through the measuring apparatus 30) is driven through a buffer amplifier circuit 54. Moreover, preferably each of the electrical signals output by amplifier circuit 48 (proportional to the rate of change in the volume of the return flow path of the drilling fluid caused by the extension and contraction of the telescoping joint in the marine riser) and by amplifier circuit 50 (proportional to the rate of change in the volume of drilling fluid stored in the annulus of the marine riser above the point at which the conduit intersects with the riser) is driven through a buffer amplifier circuit 54. Preferably the four electrical signals generated by the four buffer amplifier circuits 54 are coupled together and the combined signal is supplied to an amplifier circuit 55 which inverts the signal and amplifies it by a preselected constant. The electrical signal output from amplifier circuit 55 is proportional to the true flow rate $\bar{Q}$ of the drilling fluid flowing out of the wellhole into the marine riser.

The measuring apparatus 41 and 41*a* for determining the flow rate of the drilling fluid pumped into the drill string 30 are electrically depicted as resistors 56 and 56*a*, each of which generates an electrical signal which preferably varies from zero-to-10 volts responsive to a flow rate of zero-to-750 gallons per minute of drilling fluid.

Preferably each of the electrical signals generated by resistors 56 and 56*a* is driven through a buffer amplifier circuit 54 and the two electrical signals generated by such buffer amplifiers 54 are coupled together and supplied to an amplifier circuit 59. Amplifier 59 inverts the signal and amplifies it by a selected constant. The electrical signal generated by amplifier circuit 59 is proportional to the flow rate $Q_{in}$ of the drilling fluid pumped into the drill string.

Preferably the outputs of amplifier circuits 48, 50, and 53, and the outputs of resistors 51*a*, 56 and 56*a* are resistively coupled together and supplied to the input of an amplifier circuit 60. Amplifier circuit 60 inverts the signal and amplifies it by a selected constant, and generates an electrical signal which is proportional to the difference in flow rate $\Delta Q$ between the true flow rate $\bar{Q}$ of the drilling fluid flowing out of the wellhole into the marine riser and the flow rate $Q_{in}$ of the drilling fluid being pumped into the drill string.

Thus, the invention provides an improved method and apparatus for determining the true flow rate of drilling fluid flowing from a wellhole into a marine riser connecting between the wellhole and a floating vessel. The improved method and apparatus according to this invention has particular application in connection with the rapid and accurate detection of a blowout or lost circulation in a subaqueous wellhole being drilled from a floating vessel, wherein the flow rate of the drilling fluid being pumped from the vessel into the wellhole is compared with the true flow rate of the drilling fluid flowing out of the wellhole back to the marine riser connecting between the wellhole and the vessel. It will be apparent to those skilled in the art that the foregoing disclosure and description of the invention is illustrative and explanatory thereof and various changes may be made in the construction of the preferred apparatus within the scope of the appended claims without departing from the spirit of the invention. For example, the electrical components of the processor 42 could be digital in nature rather than analog. In addition, the electrical and mechanical components of the system may be designed to measure absolute volumes of drilling fluid rather than rate of change in volumes of the drilling fluid.

What is claimed is:

1. In a system for drilling a subaqueous wellhole from a floating vessel, which system includes a marine riser or the like connecting between the wellhole and the vessel and having a telescoping joint therein, which system further includes a drill string depending from the vessel and extending downwardly through the marine riser into the wellhole, the annulus between the drill string and marine riser providing a return flow path from the wellhole toward the vessel, which system also includes a mud system for pumping drilling fluid into the drill string and a conduit connecting between the marine riser and the mud system for providing fluid communication between the marine riser annulus and the mud system, an improved apparatus for determining in the vicinity of the vessel the flow rate of the drilling fluid flowing out of the wellhole and into the marine riser annulus, comprising:

said conduit for providing fluid communication between the marine riser and the mud system being connected to the marine riser at a selected point and being positioned such that a selected length of the end of the conduit which connects with the marine riser is continuously full of drilling fluid;

means for determining the rate of change in the volume of the drilling fluid stored in the marine riser annulus above the point at which the conduit connects with the marine riser and generating a first electrical signal proportional thereto;

means for measuring the flow rate of the drilling fluid flowing through the conduit and generating a second electrical proportional thereto, said measuring means being positioned in the length of the conduit which is continuously full of drilling fluid;

means for determining the rate of change in the volume of the flow path of the drilling fluid in the marine riser annulus caused by the extension and contraction of the marine riser telescoping joint and generating a third electrical signal proportional thereto;

means for correlating the first, second and third electrical signals and producing a fourth electrical signal proportional to the flow rate of the drilling fluid flowing out of the wellhole into the marine riser annulus.

2. In a system for drilling a subaqueous wellhole from a floating vessel, which system includes a marine riser or the like connecting between the wellhole and the vessel and having a telescoping joint therein, which system further includes a drill string depending from the vessel and extending downwardly through the marine riser into the wellhole, the annulus between the drill string and marine riser providing a return flow path from the wellhole toward the vessel, which system also includes a mud system for pumping drilling fluid into the drill string and a conduit connecting between the marine riser and the mud system for providing fluid communication between the marine riser annulus and the mud system, an improved apparatus for determining the vicinity of the vessel the flow rate of the drilling fluid flowing out of the wellhole and into the marine riser annulus, according to claim 1 wherein:

said marine riser annulus is enlarged through a selected segment of the length of the marine riser above the point at which the conduit connects with the marine riser whereby there is formed a surge tank for the receipt of drilling fluid; and the means for determining the rate of change in the volume of the drilling fluid stored in the marine riser annulus above the point at which the conduit intersects with the marine riser, further includes:

means for measuring the level of the drilling fluid in the surge tank and generating an electrical signal proportional thereto.

3. In a system for drilling a subaqueous wellhole from a floating vessel, which system includes a marine riser or the like connecting between the wellhole and the vessel and having a telescoping joint therein, which system further includes a drill string depending from the vessel and extending downwardly through the marine riser into the wellhole, the annulus between the drill string and marine riser providing a return flow path from the wellhole toward the vessel, which system also includes a mud system for pumping drilling fluid into the drill string and a conduit connecting between the marine riser and the mud system for providing fluid communication between the marine riser annulus and the mud system, an improved apparatus for determining in the vicinity of the vessel the flow rate of the drilling fluid flowing out of the wellhole and into the marine riser annulus, according to claim 2, wherein the means for measuring the level of the drilling fluid in the surge tank and generating an electrical signal proportional thereto includes:

a ring float secured around the drill string for floating on the surface of the drilling fluid in the surge tank; and at least one vertically mounted reed switch level sensor mounted within the surge tank for generating an electrical signal representative of the level of the ring float within the surge tank.

4. In a system for drilling a subaqueous wellhole from a floating vessel, which system includes a marine riser or the like connecting between the wellhole and the vessel and having a telescoping joint therein, which system further includes a drill string depending from the vessel and extending downwardly through the marine riser into the wellhole, the annulus between the drill string and marine riser providing a return flow path from the wellhole toward the vessel, which system also includes a mud system for pumping drilling fluid into the drill string and a conduit connecting between the marine riser and the mud system for providing fluid communication between the marine riser annulus and the mud system, an improved apparatus for determining the vicinity of the vessel of the flow rate of the drilling fluid flowing out of the wellhole and into the marine riser annulus according to claim 1, wherein:

the means for determining the rate of change in the volume of the drilling fluid stored in the marine riser annulus above the point which the conduit connects with the marine riser and generating a first electrical signal proportional thereto, includes:

means for measuring the level of the drilling fluid in the marine riser annulus above the point at which the conduit connects with the marine riser and generating an electrical signal proportional thereto, and the means for determining the rate of change in the volume of the flow path of the drilling fluid in the marine riser annulus caused by the extension and contraction of the marine riser telescoping joint and generating a third electrical signal proportional thereto, includes:

means for measuring the extension and contraction of the marine riser telescoping joint and generating an electrical signal proportional thereto.

5. In a system for drilling a subaqueous wellhole from a floating vessel, which system includes a marine riser or the like connecting between the wellhole and the vessel and having a telescoping joint therein, which system further includes a drill string depending from the vessel and extending downwardly through the marine riser into the wellhole, the annulus between the drill string and marine riser providing a return flow path from the wellhole toward the vessel, which system also includes a mud system for pumping drilling fluid into the drill string and a conduit connecting between the marine riser and the mud system for providing fluid communication between the marine riser annulus and the mud system, an improved apparatus for determining in the vicinity of the vessel the flow rate of the drilling fluid flowing out of the wellhole and into the marine riser annulus, according to claim 4, wherein the means for correlating the first, second and third electrical signals and producing a fourth electrical signal proportional to the flow rate of the drilling fluid flowing out of the wellhole into the marine riser annulus includes:

means for solving the following equations:

$$\bar{Q} = Q_F + A_a\, dx/dt + A_s\, dh/dt$$

wherein $\bar{Q}$ is the rate of flow of the drilling fluid out of the wellhole into the marine riser, $Q_F$ is the measured rate of flow of the drilling fluid through the conduit, $A_a$ is the annular cross-section of the flow area of the annulus between the drill string and the marine riser at the telescoping joint in the marine riser, $x$ is proportional to the linear extension and contraction of the telescoping joint in the marine riser, $A_s$ is the net cross-sectional area of the marine riser at a point above that at which the conduit connects with the marine riser, and $h$ is proportional to the height of the drilling fluid in the marine riser annulus above the point at which the conduit connects with the marine riser.

6. In a system for drilling a subaqueous wellhole from a floating vessel, which system includes a marine riser or the like connecting between the wellhole and the vessel and having a telescoping joint therein, which system further includes a drill string depending from the vessel and extending downwardly through the marine riser into the wellhole, the annulus between the drill string and marine riser providing a return flow path from the wellhole toward the vessel, which system also includes a mud system for pumping drilling fluid into the drill string and a conduit connecting between the marine riser and the mud system for providing fluid communication between the marine riser annulus and the mud system, an improved apparatus for rapidly determining in the vicinity of the vessel the existence of a blowout or lost circulation in the wellhole, according to claim 1 and further comprising:

means for determining the rate of flow of the drilling fluid from the mud system into the drill string and generating a fifth electrical signal proportional thereto; and said means for correlating the first, second, and third electrical signals includes means for correlating the first, second, third and fifth electrical signals and producing a sixth electrical signal proportional to the difference in the rate of flow of the drilling fluid into the drill string and the rate of flow of the drilling fluid out of the wellhead into the marine riser.

7. In a system for drilling a subaqueous wellhole from a floating vessel, which system includes a marine riser or the like connecting between the wellhole and the vessel and having a telescoping joint therein, which system further includes a drill string depending from the vessel and extending downwardly through the marine riser into the wellhole, the annulus between the drill string and marine riser providing a return flow path from the wellhole toward the vessel, which system also includes a mud system for pumping drilling fluid into the drill string and a conduit connecting between the marine riser and the mud system for providing fluid communicaton between the marine riser annulus and the mud system, an improved apparatus for determining in the vicinity of the vessel the flow rate of the drilling fluid flowing out of the wellhole and into the marine riser annulus, according to claim 6, wherein:

the means for determining the rate of change in the volume of the drilling fluid stored in the marine riser annulus above the point at which the conduit connects with the marine riser and generating a first electrical signal proportional thereto, further includes:

means for measuring the level of the drilling fluid stored in the marine riser annulus above the point at which the conduit intersects with the marine riser and generating an electrical signal proportional thereto, and means for differentiating such electrical signal with respect to time to produce the first electrical signal proportional to the rate of change in the volume of the drilling fluid stored in the marine riser annulus above the point at which the conduit intersects with the marine riser;

the means for determining the rate of change in the volume of the flow path of the drilling fluid in the marine riser annulus caused by the extension and contraction of the marine riser telescoping joint and generating a third electrical signal proportional thereto further includes:

means for measuring the extension and contraction of the marine riser telescoping joint and generating an electrical signal proportional thereto, and means for differentiating such electrical signal with respect to time and generating the third electrical signal proportional to the rate of change of the volume of the flow path of the drilling fluid in the marine riser annulus caused by the extension and contraction of the marine riser telescoping joint;

the means for correlating the first, second, third and fifth electrical signals further includes:

means for solving the following equation:

$$\Delta Q = (Q_F + A_a\, dx/dt + A_S\, dh/dt) - Q_{in}$$

wherein $Q_F$ is the measured rate of flow of the drilling fluid through the conduit, $A_a$ is the annular cross-section of the flow area of the annulus between the drill string and the marine riser at the telescoping joint in the marine riser, $x$ is proportional to the linear extension and contraction of the telescoping joint in the marine riser, $A_S$ is the net cross-sectional area of the marine riser at a point above that where the conduit connects with the marine riser, $h$ is proportional to the height of the drilling fluid in the marine riser annulus above the point the conduit intersects with the marine riser, and $Q_{in}$ is the flow rate of the drilling fluid from the vessel into the drill string.

8. In a system for drilling a subaqueous wellhole from a floating vessel, which system includes a marine riser or the like connecting between the wellhole and the vessel and having a telescoping joint therein, which system includes a drill string depending from the vessel and extending downwardly through the marine riser into the wellhole, the annulus between the drill string and the marine riser providing a return flow path from the wellhole toward the vessel, which system also includes a mud system for pumping drilling fluid into the drill string and a conduit connecting between the marine riser and the mud system for providing fluid communication between the marine riser annulus and the mud system, an improved apparatus for rapidly determining in the vicinity of the vessel the existence of a blowout or lost circulation in the wellhole, comprising:

means for determining the volume of the drilling fluid pumped from the vessel into the wellhole and generating a first signal proportional thereto;

said conduit for providing fluid communication between the marine riser and the mud system being connected to the marine riser at a selected point and being positioned such that a selected length of its end which connects with the marine riser is continuously full of drilling fluid;

means for determining the volume of the drilling fluid stored in the marine riser annulus above the point at which the conduit connects with the marine riser and generating a second signal proportional thereto;

means for measuring the flow rate of the drilling fluid flowing through the conduit and generating a third electrical signal proportional thereto, the measuring means being positioned in the length of the conduit which is continuously full of drilling fluid;

means for determining the volume of drilling fluid stored within the telescoping joint of the marine riser and generating a fourth electrical signal proportional thereto;

means for correlating the first, second, third and fourth signals and producing a fifth electrical signal proportional to the difference between the volume of the drilling fluid being pumped from the vessel into the wellhole and the volume of the drilling fluid returning from the wellhole to the marine riser, which difference is indicative of the existence of a blowout or lost circulation in the wellhole.

9. In a system for drilling a subaqueous wellhole from a floating vessel, which system includes a marine riser or the like connecting between the wellhole and the vessel and having a telescoping joint therein, which system includes a drill string depending from the vessel and extending downwardly through the marine riser into the wellhole, the annulus between the drill string and the marine riser providing a return flow path from the wellhole toward the vessel, which system also includes a mud system for pumping drilling fluid into the drill string and conduit connecting between the marine riser and the mud system for providing fluid communication between the marine riser annulus and the mud system, an improved apparatus for rapidly determining in the vicinity of the vessel the existence of a blowout or lost circulation in the wellhole, according to claim 8, wherein:

the marine riser annulus is enlarged through a selected segment of the length of the marine riser above the point at which the conduit connects with the marine whereby there is formed a surge tank for the receipt of drilling fluid.

10. In a system for drilling a subaqueous wellhole from a floating vessel which system includes a marine riser or the like providing a return flow path for drilling fluid flowing upwardly from the wellhole toward the vessel and which marine riser includes a telescoping joint, the system further including a drill string depending from the vessel and extending downwardly through the marine riser into the wellhole, a mud system associated with the vessel for pumping drilling fluid into the drill string and downwardly into the wellhole, and a conduit connecting between the marine riser and the mud system for providing fluid communication between the marine riser and the mud system, the method of determining the true flow rate of the drilling fluid flowing out of the wellhole and into the marine riser including the steps of:

measuring the rate of flow of the drilling fluid flowing through a portion of the conduit which is continually full of drilling fluid and generating a first signal proportional thereto;

measuring the rate of change in the volume of the drilling fluid stored in the marine riser above the point at which the conduit intersects with such riser and generating a second signal proportional thereto;

measuring the extension and contraction of the telescoping joint in the marine riser and generating a third signal proportional thereto; and compensating the first signal with the second and third signals to produce a fourth signal proportional to the true flow rate of the drilling fluid flowing out of the wellhole into the marine riser.

11. In a system for drilling a subaqueous wellhole from a floating vessel which system includes a marine riser or the like providing a return flow path for drilling fluid flowing upwardly from the wellhole toward the vessel and which marine riser includes a telescoping joint, the system further including a drill string depending from the vessel and extending downwardly through the marine riser into the wellhole, a mud system associated with the vessel for pumping drilling fluid into the drill string and downwardly into the wellhole, and a conduit connecting between the marine riser and the mud system for providing fluid communication between the marine riser and the mud system, the method of determining in the vicinity of the vessel the existence of a blowout or lost circulation in the wellhole, including the steps of:

measuring the rate of flow of the drilling fluid flowing through a portion of the conduit which is continually full of drilling fluid and generating a first signal proportional thereto;

measuring the rate of change in the volume of the drilling fluid stored in the marine riser above the point at which the conduit connects with such riser and generating a second signal proportional thereto;

measuring the extension and contraction of the telescoping joint in the marine riser and generating a third signal proportional thereto; and measuring the rate of flow of the drilling fluid pumped from the vessel into the wellhole and generating a fourth signal proportional thereto; and correlating the first, second, third and fourth signals to produce a fifth signal proportional to the difference between the flow rate of the drilling fluid being pumped from the vessel into the wellhole and the true flow rate of the drilling fluid flowing out of the wellhole into the marine riser, which difference is indicative of the existence of the blowout or lost circulation in the wellhole.

* * * * *

UNITED STATES PATENT AND TRADEMARK OFFICE

CERTIFICATE OF CORRECTION

PATENT NO. : 3,976,148

DATED : August 24, 1976

INVENTOR(S) : Leo Donald Maus and Charles Emory Barton

It is certified that error appears in the above-identified patent and that said Letters Patent are hereby corrected as shown below:

In the title, the word "wellhouse" should read -- wellhole --.

In column 1, line 21, the word "earch" should read -- earth --.

In column 7, line 41, the symbol "X" should be a lower-case -- x --.

In column 7, line 57, the " $\phi$ " symbol should not appear on this line.

In column 9, lines 24 through 33 should be deleted whereby the test of the specification reads from the end of line 23 directly to the start of line 34.

In column 10, line 33, the word "minut" should read -- minus --.

In column 11, the numerals "41" and "41a" should read -- 31 -- and -- 31a -- respectively.

Signed and Sealed this

First Day of March 1977

[SEAL]

*Attest:*

RUTH C. MASON
*Attesting Officer*

C. MARSHALL DANN
*Commissioner of Patents and Trademarks*